US008441311B2

(12) United States Patent
Lee

(10) Patent No.: US 8,441,311 B2
(45) Date of Patent: May 14, 2013

(54) VOLTAGE REGULATION CIRCUIT

(75) Inventor: Jun Gyu Lee, Ichon-si (KR)

(73) Assignee: SK Hynix Inc., Gyeonggi-do (KR)

( * ) Notice: Subject to any disclaimer, the term of this patent is extended or adjusted under 35 U.S.C. 154(b) by 218 days.

(21) Appl. No.: 12/966,683

(22) Filed: Dec. 13, 2010

(65) Prior Publication Data

US 2012/0001604 A1 Jan. 5, 2012

(30) Foreign Application Priority Data

Jul. 2, 2010 (KR) ..... 10-2010-0063999

(51) Int. Cl.
*G05F 3/02* (2006.01)
*G05F 1/10* (2006.01)

(52) U.S. Cl.
USPC ..... 327/541; 327/534

(58) Field of Classification Search ..... 327/534, 327/538, 540, 541, 543; 323/273, 280
See application file for complete search history.

(56) References Cited

U.S. PATENT DOCUMENTS 5,929,615 A * 7/1999 D'Angelo et al. ..... 323/224
6,429,726 B1 8/2002 Bruneau et al.
6,731,158 B1 5/2004 Hass
6,801,033 B2 * 10/2004 Sudo et al. ..... 324/750.3
6,861,832 B2 * 3/2005 Perez ..... 323/316
7,592,832 B2 9/2009 Perisetty
2005/0280463 A1 12/2005 Chih
2006/0038605 A1 2/2006 Pineda De Gyvez et al.
2006/0091934 A1 * 5/2006 Pan ..... 327/534
2007/0273347 A1 * 11/2007 Chuang et al. ..... 323/282

FOREIGN PATENT DOCUMENTS

KR 1020040024789 A 3/2004
KR 1020080001054 A 1/2008
KR 1020100054473 A 5/2010

* cited by examiner

*Primary Examiner* — Quan Tra
(74) *Attorney, Agent, or Firm* — William Park & Associates Patent Ltd.

(57) ABSTRACT

A voltage regulation circuit includes: a first voltage divider that divides a regulation voltage with a predetermined division ratio to generate a division voltage; a first current driving force control unit configured to compare a reference voltage with the division voltage and generate a first control signal; a current driving unit configured to generate a driving current with a variable driving force based on the first control signal and a second control signal, and generate the regulation voltage; and a second current driving force control unit configured to generate the second control signal in accordance with a level variation of the regulation voltage.

7 Claims, 3 Drawing Sheets

VOLTAGE REGULATION CIRCUIT

CROSS-REFERENCES TO RELATED APPLICATION

The present application claims priority under 35 U.S.C. §119(a) to Korean Application No. 10-2010-0063999, filed on Jul. 2, 2010, in the Korean Intellectual Property Office, which is incorporated herein by reference in its entirety as if set forth in full.

BACKGROUND

1. Technical Field

The present invention relates to a semiconductor circuit, and more particularly, to a voltage regulation circuit.

2. Related Art

In a semiconductor circuit, for example, a semiconductor is memory uses a voltage regulation circuit to generate various internal voltages such as a peripheral circuit voltage (VPERI) and a core voltage (VCORE) at stable levels.

A conventional voltage regulation circuit may use a PMOS transistor to drive current by a power supply voltage, that is, an external voltage (VDD).

A method of increasing the size of the PMOS transistor is employed as a method of increasing the current driving force of the PMOS transistor.

If the size of the transistor is increased, the circuit area increases, and parasitic capacitance increases to degrade operation speed.

SUMMARY

A voltage regulation circuit which may reduce circuit area and increase current driving force is described herein.

In one embodiment of the invention, a voltage regulation circuit includes: a first voltage divider that divides a regulation voltage with a predetermined division ratio to generate a division voltage; a first current driving force control unit configured to compare a reference voltage with the division voltage and generate a first control signal; a current driving unit configured to generate a driving current with a variable driving force based on the first control signal and a second control signal, and generate the regulation voltage; and a second current driving force control unit configured to is generate the second control signal in accordance with a level variation of the regulation voltage.

In another embodiment of the invention, a voltage regulation circuit includes: a primary voltage divider that divides a regulation voltage with a predetermined division ratio to generate a division voltage; a first current driving force control unit configured to compare a reference voltage with the division voltage and generate a first control signal; a current driving unit configured to generate a driving current with a variable driving force based on the first control signal and a plurality of second control signals, and generate the regulation voltage; and a second current driving force control unit configured to generate the plurality of second control signals in accordance with a level variation of the regulation voltage.

BRIEF DESCRIPTION OF THE DRAWINGS

The accompanying drawings, which are incorporated in and constitute a part of this specification, illustrate various embodiments consistent with the invention and, together with the description, serve to explain the principles of the invention.

DETAILED DESCRIPTION

Figure 1:
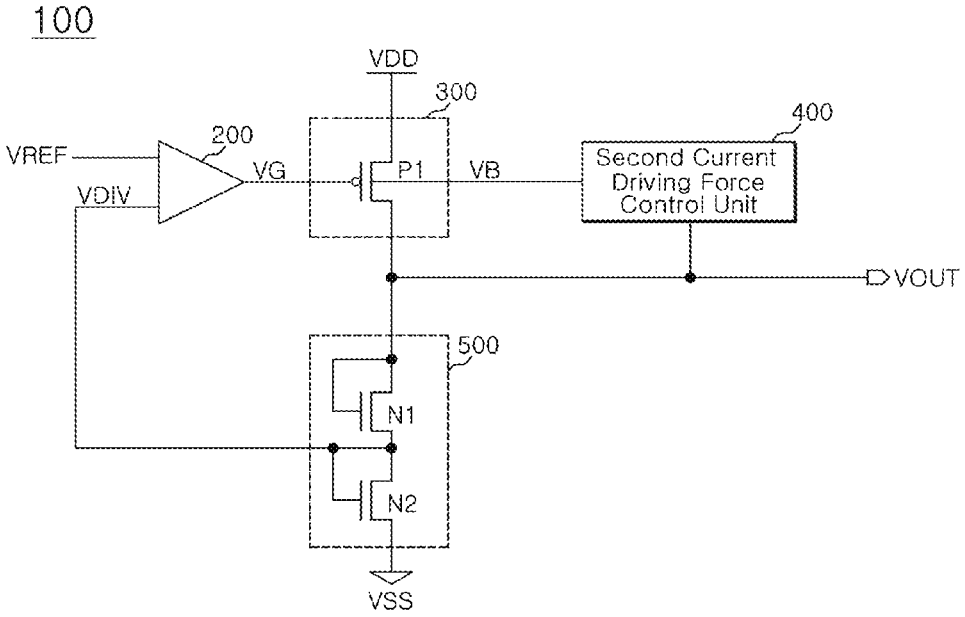
FIG. 1 is a configuration diagram of a voltage regulation circuit in accordance with an embodiment of the invention.

Reference will now be made in detail to the exemplary embodiments consistent with the present disclosure, examples of which are illustrated in the accompanying drawings. Wherever possible, the same reference characters will be used throughout the drawings to refer to the same or like parts.

Before describing the embodiments, the operation principle of the embodiments will be described below.

A current driving force I of a saturated region can be expressed with the following equation.

$$I = \frac{1}{2}\mu_p C_{ox}\frac{W}{L}(V_{sg} - |V_{thp}|)^2$$

A current driving force I of a linear region can be expressed with the following equation.

$$I = \mu_p C_{ox}\frac{W}{L}\left\{(V_{sg} - |V_{thp}|)V_{sd} - \frac{1}{2}V_{sd}^2\right\}$$

It can be readily seen from the above equations that a gate level Vsg and a threshold voltage of a transistor are largely involved in the control of a current driving force.

That is to say, it can be understood that a current driving force increases as a threshold voltage decreases.

A threshold voltage $V_T$ can be expressed with the following equation.

$$V_T = V_{T0} + \gamma(\sqrt{|-2\phi_F + V_{SB}|} = \sqrt{|-2\phi_F|}$$

It can be readily seen from this equation that the threshold voltage $V_T$ changes depending upon the level of the voltage applied to the bulk terminal of a transistor.

As a source-bulk voltage $V_{SB}$ increases, that is, the level of the voltage applied to the bulk terminal decreases, the threshold voltage $T_T$ decreases.

However, if the threshold voltage $V_T$ becomes too low, the leakage current of a transistor P1 of a current driving unit 300 may increase.

Accordingly in the embodiments, it is possible to prevent leakage current from increasing and control a current driving force without increasing the size of the transistor by changing the threshold voltage of a current driving transistor in accordance with the level of a regulation voltage VOUT.

Referring to FIG. 1, a voltage regulation circuit 100 in accordance with the embodiment includes a first current driving force control unit 200, a current driving unit 300, a second current driving force control unit 400, and a voltage divider 500.

The first current driving force control unit 200 is configured to compare a reference voltage VREF with a division voltage VDIV and generate a first control signal VG.

The first current driving force control unit 200 may comprise a differential amplifier.

The current driving unit 300 is configured to drive current with a variable current driving force based on the first control signal VG and a second control signal VB, and generate a regulation voltage VOUT.

The current driving unit 300 may include a transistor P1.

The transistor P1 has a gate to which the first control signal VG is inputted, a source to which a power supply voltage VDD is inputted, and a bulk terminal to which the second control signal VB is inputted.

The second current driving force control unit 400 is configured to generate the second control signal VB which has a level conforming to a level variation of the regulation voltage VOUT.

The voltage divider 500 is configured to divide the regulation voltage VOUT to have a predetermined division ratio, for example, ½, and generate the division voltage VDIV.

The voltage divider 500 may include a plurality of transistors N1 and N2, while the specific implementation of the voltage divider 500 is not limited thereto.

Figure 2:
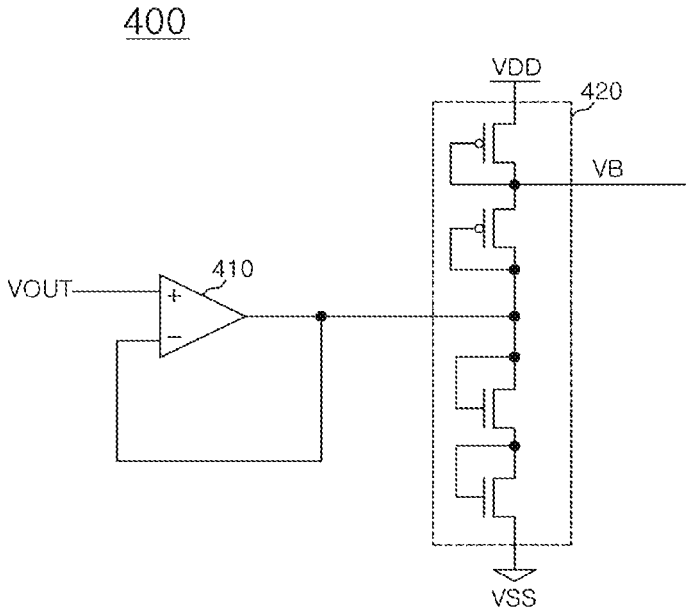
FIG. 2 is a circuit diagram of a second current driving force control unit shown in FIG. 1.

Referring to FIG. 2, the second current driving force control unit 400 is configured to divide the regulation voltage VOUT with a preset division ratio and generate the second control signal VB.

The second current driving force control unit 400 includes a buffer 410 and a voltage divider 420.

The voltage divider 420 includes a plurality of resistors which are coupled in series between the terminal of the power supply is voltage VDD and a ground terminal.

The plurality of resistors may be configured by coupling transistors in a diode type.

While it is exemplified in FIG. 2 that four resistors are coupled, it is conceivable that the number of resistors may be changed in accordance with a desired division ratio in designing a circuit.

The buffer 410 is a unit gain buffer which is configured to prevent noise from being applied to the voltage divider 420 in the circuit configuration for generating the regulation voltage VOUT. Accordingly, the embodiment can be realized in such a way as to remove the buffer 410 and directly apply the regulation voltage VOUT to the voltage divider 420.

Hereafter, a voltage regulation operation according to the embodiment will be described.

The first current driving force control unit 200 compares the reference voltage VREF with the division voltage VDIV and generates the first control signal VG.

The current driving unit 300 drives current with a variable current driving force depending upon the first control signal VG and the second control signal VB and generates the regulation voltage VOUT.

A voltage level between the power supply voltage VDD and the regulation voltage VOUT is divided to have the division ratio preset by the voltage divider 420, and is inputted as the second control signal VB to the bulk terminal of the transistor P1 of the current driving unit 300.

The threshold voltage of the transistor P1 is controlled depending upon the level of the second control signal VB.

In the case where the regulation voltage VOUT has a normal level, that is, approaches a level targeted by circuit design, the level of the second control signal VB which is generated by dividing the regulation voltage VOUT increases in proportion to the regulation voltage VOUT.

As the threshold voltage of the transistor P1 of the current driving unit 300 increases, current leakage is accordingly prevented.

Conversely, in the case where the regulation voltage VOUT is low when compared to the normal level, a large amount of current is needed to raise the regulation voltage VOUT to the normal level.

Since the regulation voltage VOUT is in a low level, the level of the second control signal VB which is generated by dividing the regulation voltage VOUT decreases in proportion to the regulation voltage VOUT.

Since the level of the second control signal VB decreases, the threshold voltage of the transistor P1 of the current driving unit 300 decreases, and as a result, the current driving force of the transistor P1 increases.

Accordingly, as the transistor P1 of the current driving unit 300 drives current with an increased current driving force, the level of the regulation voltage VOUT can be quickly raised to a desired is level.

As is apparent from the above description, in the embodiment of the present invention, due to the fact that the threshold voltage of the transistor is controlled in accordance with the level variation of the regulation voltage VOUT, a current driving force can be controlled in correspondence to a currently needed amount of current.

Hereinafter, another embodiment of the present invention will be described in detail with reference to the accompanying drawings.

Figure 3:
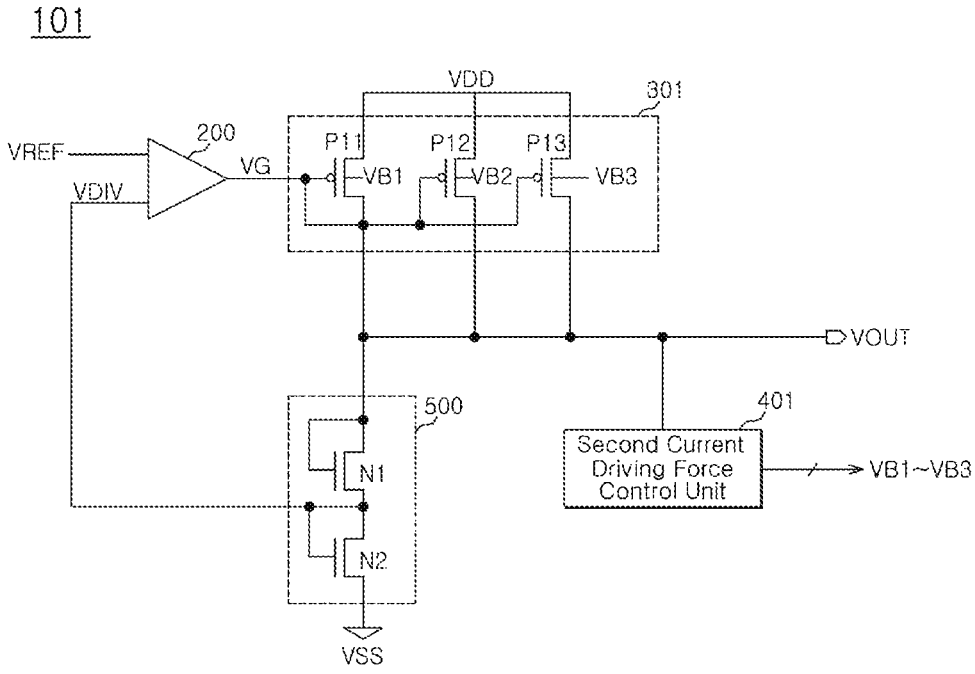
FIG. 3 is a configuration diagram of a voltage regulation circuit in accordance with another embodiment of the invention.

Referring to FIG. 3, a voltage regulation circuit 101 in accordance with another embodiment of the present invention is configured with the same operation principle as the aforementioned embodiment. The voltage regulation circuit 101 may be configured the same as FIG. 1 except a current driving unit 301 and a second current driving force control unit 401.

The voltage regulation circuit 101 in accordance with another embodiment of the present invention shown in FIG. 3 is configured in such a manner that an overall current driving force is increased when compared to the embodiment shown in FIG. 1 and the levels of a plurality of second control signals VB1 through VB3 can be controlled within the same range or different ranges.

The current driving unit 301 is configured to drive current with a variable current driving force based on a first control signal VG and a plurality of second control signals VB1 through VB3, and is generate a regulation voltage VOUT.

The current driving unit 301 includes a plurality of transistors P11 through P13 which are coupled in series between the terminal of a power supply voltage VDD and the output terminal of the regulation voltage VOUT.

The plurality of transistors P11 through P13 have gates to which the first control signal VG is commonly inputted, sources to which the power supply voltage VDD is inputted, and bulk terminals to which the plurality of second control signals VB1 through VB3 are respectively inputted.

The second current driving force control unit 401 is configured to generate the plurality of second control signals VB1 through VB3 which have levels conforming to a level variation of the regulation voltage VOUT.

Figure 4:
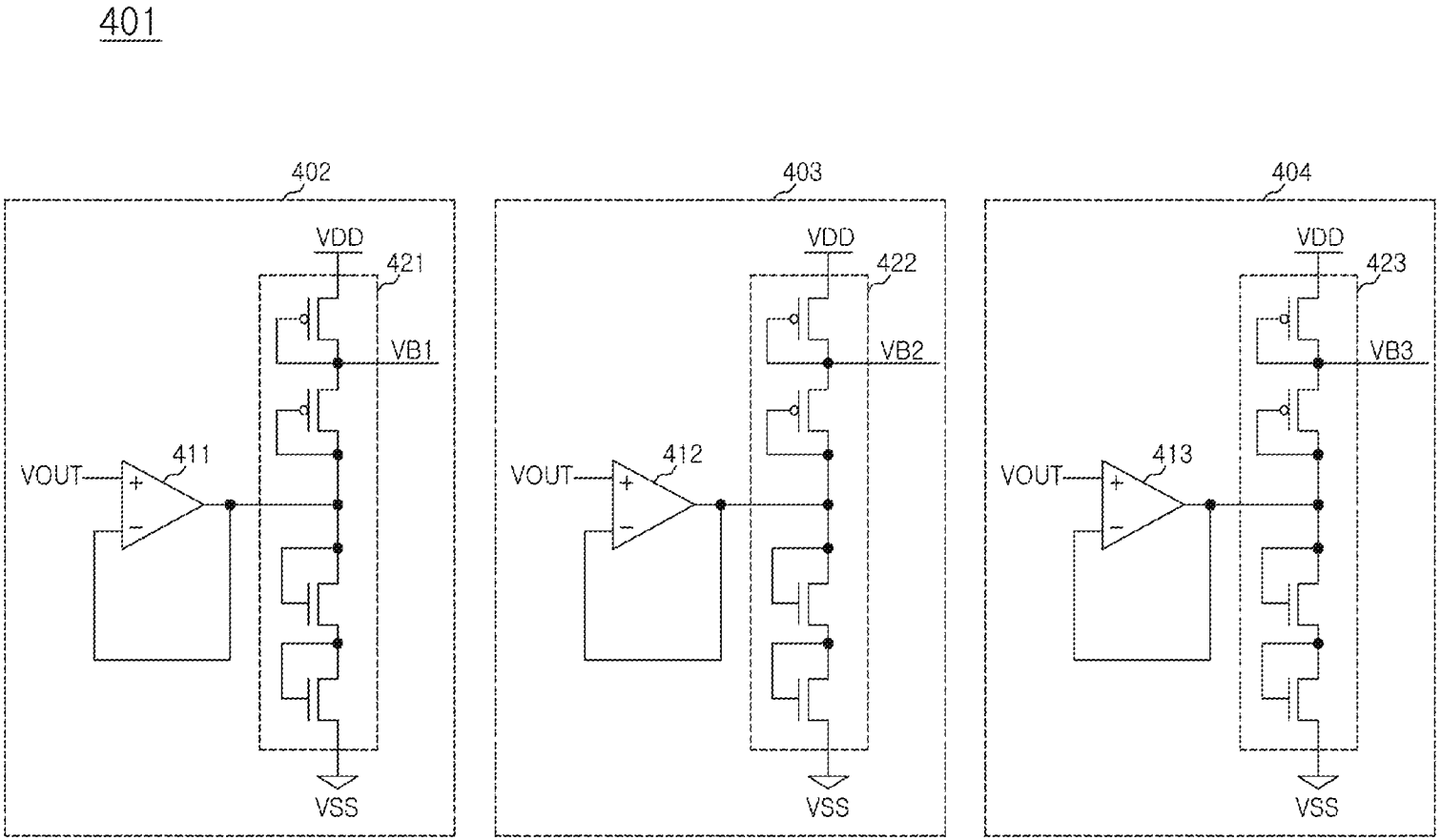
FIG. 4 is a circuit diagram of a second current driving force control unit shown in FIG. 3.

Referring to FIG. 4, the second current driving force control unit 401 is configured to divide the regulation voltage VOUT with a preset division ratio and generate the plurality of second control signals VB1 through VB3.

The second current driving force control unit 401 includes a plurality of control sections 402 through 404 for respectively generating the plurality of second control signals VB1 through VB3.

The control section 402 includes a buffer 411 and a voltage divider 421.

The voltage divider 421 includes a plurality of resistors which are coupled in series between the terminal of the power supply is voltage VDD and a ground terminal.

The plurality of resistors may be configured by coupling transistors in a diode type.

While it is exemplified in FIG. 4 that the voltage divider 421 is configured by coupling four resistors, it is conceivable that the number of resistors may be changed in accordance with a desired division ratio in designing a circuit.

The buffer 411 is a unit gain buffer which is configured to prevent noise from being applied to the voltage divider 421 in the circuit configuration for generating the regulation voltage VOUT. Accordingly, it can be envisaged that the embodiment of the present invention can be realized in such a way as to remove the buffer 411 and directly apply the regulation voltage VOUT to the voltage divider 421.

In the case where the levels of the plurality of second control signals VB1 through VB3 are controlled within the same range, the other control sections 403 and 404 may be configured in the same way as the control section 402.

However, in the case where the levels of the plurality of second control signals VB1 through VB2 are controlled within different ranges, voltage dividers 422 and 423 of the other control sections 403 and 404 are configured in different ways from the control section 402.

In other words, in the voltage dividers 421 through 423, the number of resistors and the positions of nodes from which the plurality of second control signals VB1 through VB3 are outputted may be varied.

Hereafter, a voltage regulation operation according to another embodiment of the present invention will be described.

The first current driving force control unit 200 compares the reference voltage VREF with the division voltage VDIV and generates the first control signal VG.

The current driving unit 301 drives current with a variable current driving force depending upon the first control signal VG and the plurality of second control signals VB1 through VB3 and generates the regulation voltage VOUT.

A voltage level between the power supply voltage VDD and the regulation voltage VOUT is divided to have division ratios preset by the respective voltage dividers 421 through 423, and is inputted as the plurality of second control signals VB1 through VB3 to the bulk terminals of the transistors P11 through P13 of the current driving unit 301.

The threshold voltages of the transistors P11 through P13 are controlled depending upon the levels of the plurality of second control signals VB1 through VB3.

In the case where the regulation voltage VOUT has a normal level, that is, approaches a level targeted upon circuit design, the levels of the plurality of second control signals VB1 through VB3 which are generated by dividing the regulation voltage VOUT increase in proportion to the regulation voltage VOUT.

Accordingly, as the threshold voltages of the transistors P11 through P13 of the current driving unit 301 increase, current leakage is prevented.

Conversely, in the case where the regulation voltage VOUT is low when compared to the normal level, a large amount of current is needed to raise the regulation voltage VOUT to the normal level.

Since the regulation voltage VOUT is in a low level, the levels of the plurality of second control signals VB1 through VB3 which are generated by dividing the regulation voltage VOUT decrease in proportion to the regulation voltage VOUT.

Since the levels of the plurality of second control signals VB1 through VB3 decrease, the threshold voltages of the transistors P11 through P13 of the current driving unit 301 decrease, and as a result, the current driving forces of the transistors P11 through P13 increase.

Accordingly, as the transistors P11 through P13 of the current driving unit 301 drive current with an increased current driving force, the level of the regulation voltage VOUT can be more quickly raised to a desired level when compared to the embodiment shown in FIG. 1.

As is apparent from the above description, in the embodiment of the present invention, due to the fact that the threshold voltages of the transistors for driving current are controlled, a current driving force can be increased without increasing the sizes of the transistors.

While certain embodiments have been described above, it will be understood to those skilled in the art that the embodiments described are by way of example only. Accordingly, the voltage regulation circuit described herein should not be limited based on the described embodiments. Rather, the voltage regulation circuit described herein should only be limited in light of the claims that follow when taken in conjunction with the above description and accompanying drawings.

What is claimed is:

1. A voltage regulation circuit comprising:

a primary voltage divider that divides a regulation voltage with a predetermined division ratio to generate a division voltage;

a first current driving force control unit configured to compare a reference voltage with the division voltage and generate a first control signal;

a current driving unit configured to generate a driving current with a variable driving force based on the first control signal and a plurality of second control signals, and generate the regulation voltage; and a second current driving force control unit configured to generate the plurality of second control signals in accordance with a level variation of the regulation voltage, wherein the second current driving force control unit comprises a plurality of control sections for respectively generating the plurality of second control signals, and wherein each of the control sections comprises a secondary voltage divider which is coupled between a terminal of the power supply voltage and a ground terminal, and the secondary voltage divider comprises a plurality of diode-connected transistors.

2. The voltage regulation circuit according to claim 1, wherein the second current driving force control unit is configured to divide a voltage level between a power supply voltage and the regulation voltage with a plurality of division ratios and generate the plurality of second control signals.

3. The voltage regulation circuit according to claim 1, wherein the first current driving force control unit comprises a differential amplifier.

4. The voltage regulation circuit according to claim 1, wherein the current driving unit comprises a plurality of transistors, each of the transistors having a source which is coupled to the terminal of the power supply voltage and a gate that receives the first control signal, and wherein a threshold voltage of each of the transistors varies depending upon the respective second control signals.

5. The voltage regulation circuit according to claim 4, wherein the second current driving force control unit is configured to independently change voltage levels of bulk terminals of the plurality of transistors by using the plurality of second control signals.

6. The voltage regulation circuit according to claim 4, wherein the second current driving force control unit comprises a second voltage divider which is coupled between a terminal of the power supply voltage and a ground terminal, the second voltage divider comprises a plurality of diode-connected transistors.

7. The voltage regulation circuit according to claim 4, wherein the first current driving force control unit comprises a differential amplifier.

* * * * *